US007872661B2

(12) United States Patent
Lim et al.

(10) Patent No.: US 7,872,661 B2
(45) Date of Patent: Jan. 18, 2011

(54) IMAGE BEARING STRUCTURE AND METHOD TO DETECT A DEFECT IN THE IMAGE BEARING STRUCTURE

(75) Inventors: Seong-taek Lim, Suwon-si (KR); Soon-cheol Kweon, Seoul (KR); Seung-jin Oh, Atsugi (JP); Ki-hwan Kwon, Hwaseong (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 113 days.

(21) Appl. No.: 12/180,808

(22) Filed: Jul. 28, 2008

(65) Prior Publication Data

US 2009/0180681 A1 Jul. 16, 2009

(30) Foreign Application Priority Data

Jan. 15, 2008 (KR) ..... 10-2008-0004422

(51) Int. Cl.
*B41J 2/41* (2006.01)
*G03G 15/00* (2006.01)

(52) U.S. Cl. ..... 347/112; 347/141

(58) Field of Classification Search ..... 347/112, 347/141

See application file for complete search history.

(56) References Cited

U.S. PATENT DOCUMENTS

| | | | | |
|---|---|---|---|---|
| 5,198,839 | A * | 3/1993 | Takahashi et al. | 347/147 |
| 6,014,157 | A * | 1/2000 | Slot et al. | 347/141 |
| 2007/0120940 | A1 * | 5/2007 | Shin et al. | 347/141 |
| 2007/0132827 | A1 * | 6/2007 | Bae et al. | 347/169 |
| 2007/0137776 | A1 * | 6/2007 | Back et al. | 156/245 |
| 2007/0138018 | A1 * | 6/2007 | Choi et al. | 205/127 |
| 2008/0136889 | A1 * | 6/2008 | Yoon et al. | 347/141 |

FOREIGN PATENT DOCUMENTS

| | | | |
|---|---|---|---|
| KR | 10-2008-0056598 | * | 6/2008 |
| KR | 10-0878537 | * | 1/2009 |

OTHER PUBLICATIONS

"Smart Printhead Electronics controls Print Quality in Oce's Direct Imaging Process"; Marcel Slot and Rene van der Meer; Oce-Technologies B.V.; Venlo, The Netherlands; pp. 690-695.

* cited by examiner

*Primary Examiner*—Huan H Tran
(74) *Attorney, Agent, or Firm*—Stanzione & Kim LLP

(57) ABSTRACT

An image bearing structure includes an image drum including at least one slot, a plurality of ring electrodes formed on an outer circumference of the image drum, and a control board positioned within the slot of the image drum, and connected to the plurality of ring electrodes, to detect a defect of the ring electrodes. As a result, the image bearing structure detects a defect within a short time and without requiring a separate detecting device.

20 Claims, 5 Drawing Sheets

IMAGE BEARING STRUCTURE AND METHOD TO DETECT A DEFECT IN THE IMAGE BEARING STRUCTURE

CROSS-REFERENCE TO RELATED APPLICATIONS

This application claims priority under 35 U.S.C. §119(a) from Korean Patent Application No. 2008-04422 filed Jan. 15, 2008, in the Korean Intellectual Property Office, the disclosure of which is incorporated herein by reference in its entirety.

BACKGROUND OF THE INVENTION

1. Field of the Invention

The present general inventive concept relates to an image bearing structure and a method to detect a defect in the image bearing structure. More particularly, the present general inventive concept relates to an image bearing structure to detect an open or short state of a ring electrode, and a method to detect a defect in the image bearing structure.

2. Description of the Related Art

A 'direct' printing refers to a printing operation to form an image by directly applying an image signal onto an image drum, thereby forming a latent image thereon, and developing the latent image. The direct printing does not require devices such as a light exposure unit or electric potential charging unit, which is generally required in an electrophotographic printing, and also provides stable processing. Therefore, the direct printing has constantly been researched.

FIG. 1 illustrates an image forming apparatus employing a conventional image bearing structure.

Referring to FIG. 1, a latent image is formed on the image bearing structure 10, and toner is fed from a toner feed unit 60 and attached onto the image bearing structure 10. The final form of image is formed in a direct printing manner, as some of the toner is separated from the image bearing structure 10 by a magnetic cover 70, while the remaining toner is transferred onto a printing medium.

The above process requires a plurality of ring electrodes to be disposed on a surface of the image bearing structure 10. An arrangement of the ring electrodes may vary according to a desired resolution. For example, approximately 5000 ring electrodes are disposed at regular intervals on the surface of the image drum, in order to achieve resolution of 600 Dpi for an A4 size paper. The 5000 electrodes have to be connected electrically to corresponding control units to form a correct image and to provide reliability to the users. Therefore, electrical connections of the electrodes are inspected periodically, to ensure that no defect such as electrical open or short circuit occurs, as this can cause serious problems such as electric leakage or fire.

Conventionally, detecting devices are installed separately from the image bearing structure to determine whether the electrical connection of all the 5000 or more electrodes is stable. Accordingly, this conventional method requires separate detecting devices and long inspecting hours.

SUMMARY OF THE INVENTION

The present general inventive concept provides an image bearing structure to detect a defect therein, without requiring a separate detecting device, and a method to detect a defect thereof.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept can substantially be achieved by providing an image bearing structure including an image drum including at least one slot, a plurality of ring electrodes formed on an outer circumference of the image drum, and a control board positioned within the slot of the image drum, and connected to the plurality of ring electrodes, to detect a defect of the ring electrodes.

The control board may include a power supply unit to supply power to the plurality of ring electrodes, and a detecting unit to detect a defect by measuring a voltage value of the ring electrodes in receipt of the power.

The detecting unit may include a capacitor unit connected to the plurality of ring electrodes in parallel, a switch unit to adjust the supply of power to the ring electrodes and the capacitor unit according to an external control signal, and a comparator unit to compare the voltage value of the capacitor unit with a predetermined reference voltage.

The capacitor unit may include a first capacitor to maintain the same electric potential as that of the ring electrodes, and a second capacitor to be selectively connected to the ring electrodes according to the connection state of the switch unit.

The switch unit may include a first switch to connect the power supply unit to the first capacitor and the ring electrodes selectively, and a second switch to connect the ring electrodes to the second capacitor selectively.

The second capacitor has a greater capacitance than that of the first capacitor.

The comparator unit may include an OP-AMP.

The image bearing structure may further include an output unit to output a result of comparison to the plurality of ring electrodes.

The power supply unit and the detecting unit are integrated in a single application-specific integrated circuit (ASIC) chip.

The image drum is a hollow cylindrical body, and has at least one slot extending in a lengthwise direction.

The foregoing and/or other aspects and utilities of the present general inventive concept can substantially be achieved by providing a method to detect a defect in an image bearing device including an image drum, and a plurality of ring electrodes formed on an outer circumference of the image drum, in which the method may include supplying power to the plurality of ring electrodes selectively, measuring voltages of the ring electrodes respectively, and detecting a defect in each of the ring electrodes by comparing the measured voltages with a predetermined voltage value.

The supplying operation may include supplying the power to the plurality of ring electrodes and to a first capacitor connected to the plurality of ring electrodes in parallel, and discharging a second capacitor which is connected to the plurality of ring electrodes in parallel.

The measuring operation may include connecting the plurality of ring electrodes and the first capacitor to the second capacitor, and measuring the voltages of the plurality of ring electrodes, respectively.

The detecting operation may include comparing the measured voltages with a predetermined voltage value using an OP-AMP.

The supplying operation, measuring operation and detecting operation are performed with respect to each of the plurality of ring electrodes in sequential order.

The method according to an aspect of the present general inventive concept may further include outputting a result of the detection with respect to the plurality of ring electrodes in a serial manner.

The foregoing and/or other aspects and utilities of the general inventive concept may also be achieved by providing an image bearing device including an image drum having a plurality of ring electrodes, and a detecting unit to detect a defect in each of the ring electrodes by comparing measured voltages of the ring electrodes with a predetermined voltage value.

The foregoing and/or other aspects and utilities of the general inventive concept may also be achieved by providing an image bearing device including an image drum having a plurality of ring electrodes, a capacitor unit connected to the plurality of ring electrodes, a switch unit to adjust a supply of power to the ring electrodes and the capacitor unit according to an external control signal, and a comparator unit to compare a voltage value of the capacitor unit with a predetermined reference voltage, wherein a defect in the plurality of rings is identified based on a compared result of the comparator unit.

The foregoing and/or other aspects and utilities of the general inventive concept may also be achieved by providing a computer-readable recording medium having embodied thereon a computer program to execute a method, wherein the method including measuring voltages of ring electrodes, and detecting a defect in each of the ring electrodes by comparing the measured voltages of the ring electrodes with a predetermined voltage value.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
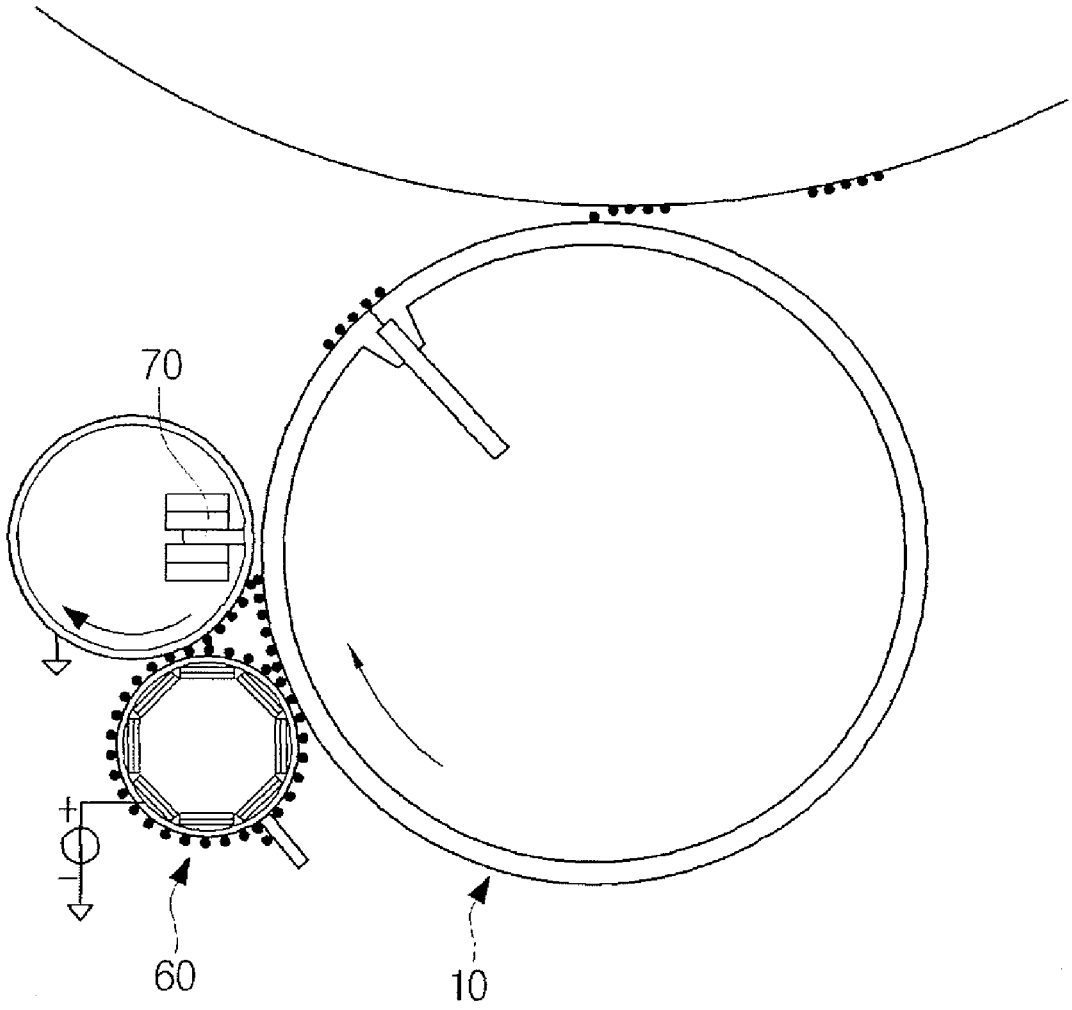
FIG. 1 (PRIOR ART)
FIG. 1 illustrates an image forming apparatus employing a conventional image bearing structure.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

The matters defined in the description, such as a detailed construction and elements thereof, are provided to assist in a comprehensive understanding of the general inventive concept. Thus, it is apparent that the general inventive concept may be carried out without those defined matters. Also, well-known functions or constructions are omitted to provide a clear and concise description of exemplary embodiments herein.

Figure 2:
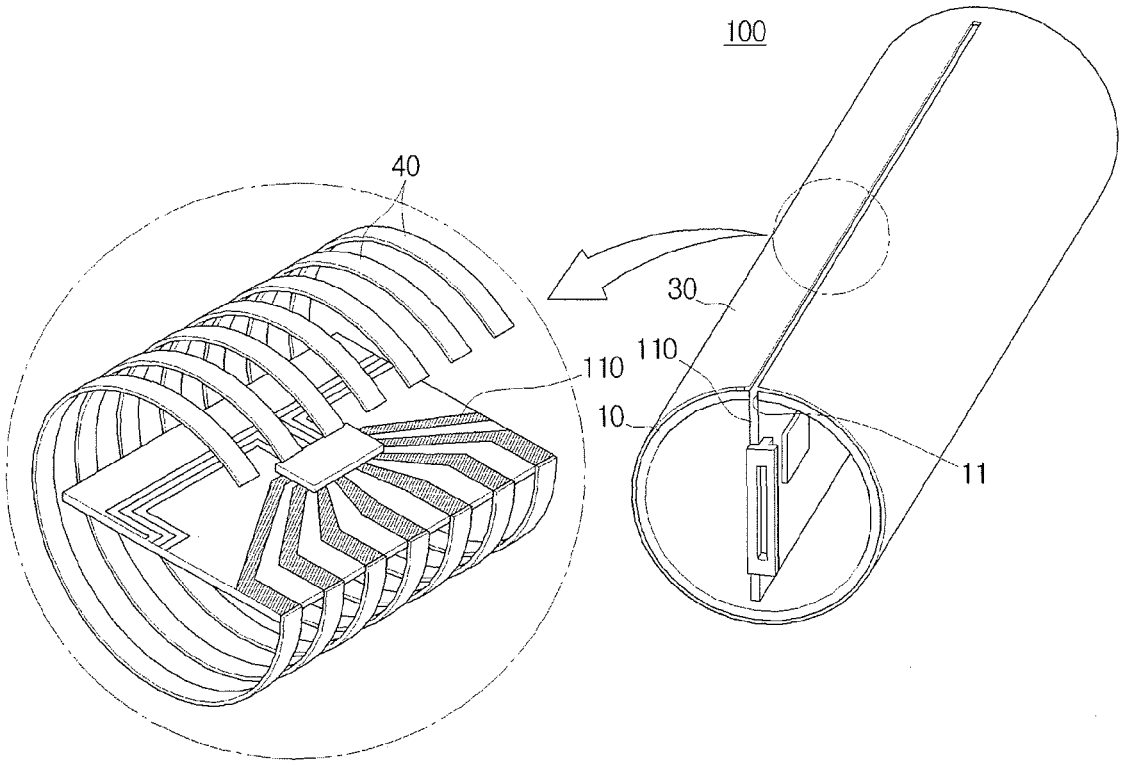
FIG. 2 illustrates a structure of an image bearing structure according to an exemplary embodiment of the present general inventive concept.

FIG. 2 illustrates a structure of an image bearing structure according to an exemplary embodiment of the present general inventive concept.

Referring to FIG. 2, an image bearing structure 100 of an image forming apparatus includes an image drum 10, a control board 110, and a plurality of ring electrodes 40.

The image drum 10 includes at least one slot 11. Specifically, the image drum 10 may be provided as a cylindrical drum having at least one slot 11 extending in a lengthwise direction. The image drum 10 may be formed from an aluminum Al which has superior heat conductivity, mechanical strength and processability.

The ring electrodes 40 are formed on an outer circumference of the image drum 10. Specifically, the ring electrodes 40 are disposed at predetermined intervals from each other on the outer circumference of the image drum 10. The ring electrodes 40 may have approximately 40 μm of pitches to accomplish resolution of about 600 Dpi. The pitches of the ring electrodes 40 may vary according to the resolutions required.

An insulating layer 30 may be disposed between the ring electrodes 40 and the image drum 10 for the insulation between the ring electrodes 40 and the outer circumference of the image drum 10. Accordingly, the ring electrodes 40 are insulated from the image drum 10, and as power is applied to the ring electrodes 40, an electromagnetic force is generated. The electric characteristic of the ring electrodes 40 and the image drum 10 may be modeled after a capacitor (Cd) as illustrated in FIG. 5.

The control board 110 includes a plurality of terminals. The control board 110 is installed within the image drum 10 so that the terminals are placed in the slot 11. FIG. 2 illustrates an example where the control board 110 is inserted in the slot 11 and supported therein so that one edge thereof forms an even outer surface with the outer circumference of the image drum 10. Accordingly, the terminals on the control board 110 are exposed through the slot 11, and connected to the ring electrodes 40 respectively.

While one single control board 110 and one single slot 11 are explained as an example, one will understand that a number of the control boards 110 and slots 11 of the image drum 10 to correspond to the control boards 110 may vary according to conditions to form images as required by the image bearing structure 100.

The control board 110 detects a defect in the ring electrodes 40. Specifically, the control board 110 supplies power to the ring electrodes 40 and detects whether the ring electrodes 40 contain a defect such as an open or short circuit. The structure of the control board 110 will be explained below in greater detail with reference to FIGS. 3 and 4.

Figure 3:
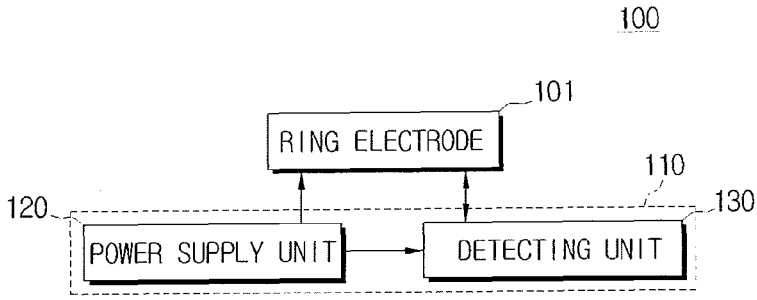
FIG. 3 illustrates a construction of an image bearing structure according to an exemplary embodiment of the present general inventive concept.

FIG. 3 is a block diagram illustrating the control board 110 of the image bearing structure 100 in FIG. 2.

Referring to FIG. 3, the control board 110 includes a power supply unit 120 and a detecting unit 130.

The power supply unit 120 selectively supplies power to the plurality of ring electrodes 40 in response to an external control signal. Specifically, the power supply unit 120 steps up a voltage (approximately, 40V) and supplies the resultant voltage to the ring electrodes 40 so that an electromagnetic force is generated to draw toner onto the surface of the image bearing structure 100. A single ASIC chip may be implemented to integrate both the power supply unit 120 and the detecting unit 130 which will be explained below in detail.

The detecting unit 130 measures voltage values from the plurality of ring electrodes 40 to receive power from the power supply unit 120, to detect a presence of a defect. The detecting unit 130 may detect the plurality of ring electrodes 40 at the same time, or in a sequential order. The detecting unit 130 will be explained in further detail below with reference to FIG. 5.

Figure 4:
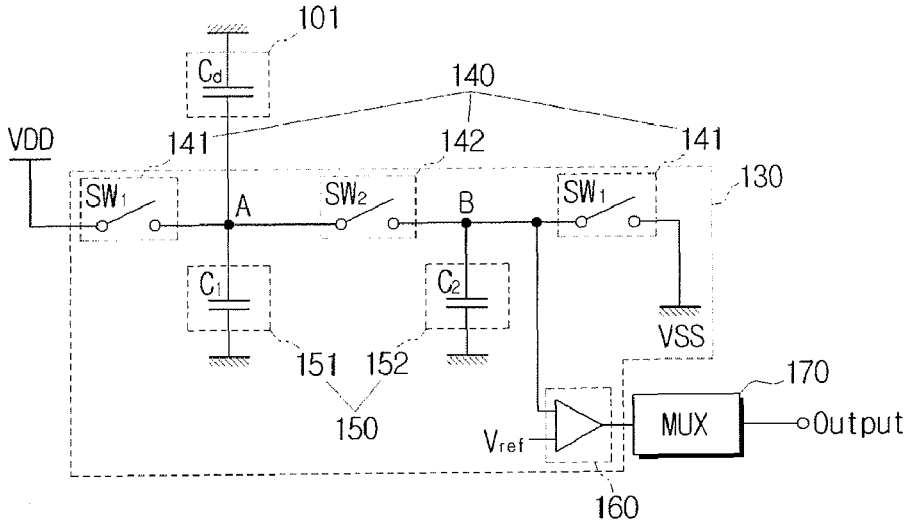
FIG. 4 is a circuit diagram illustrating a model of an image bearing structure according to an exemplary embodiment of the present general inventive concept.

FIG. 4 is a circuit diagram illustrating a model of an image bearing structure according to an exemplary embodiment of the present general inventive concept.

Referring to FIGS. 3 and 4, a circuit corresponds to one single ring electrode of the plurality of ring electrodes 101 of the image bearing structure 100. However, the control board 110 includes a plurality of circuits to correspond to the example illustrated in FIG. 4, which are connected to the plurality of ring electrodes 101.

The detecting unit 130 may include a capacitor unit 150, a switch unit 140 and a comparator unit 160.

The capacitor unit 150 may be connected in parallel to the plurality of ring electrodes 101. In one implementation, the capacitor unit 150 may include a first and second capacitors 151 and 152.

The first capacitor 151 maintains a same electric potential as the ring electrode 101. Specifically, one end of the first capacitor 151 is connected to the ring electrode 101 and the power supply unit 120 (node A), while an opposite end is grounded. As a result, the first capacitor 141 is connected to the ring electrode 101 in parallel, and performs the same charging and discharging operations as the ring electrode 101 does.

The second capacitor 152 is selectively connected to the ring electrode 101 according to a connection to the switch unit 140. Specifically, one end of the second capacitor 142 is either connected through the switch unit 140 to the node A to which the first capacitor 151 and the ring electrode 101 are connected, or grounded (node B). An opposite end of the second capacitor 142 is grounded. The second capacitor 152 may have a greater capacitance than that of the first capacitor 151.

The switching unit 140 adjusts a supply of power to the plurality of ring electrodes 101 and the capacitor unit 150 according to an external control signal. The switching unit 140 may include a first and second switches 141 and 142 operating inversely to each other.

The first switch 141 may selectively connect the power supply unit 110 to the first capacitor 151 and the ring electrode 101. Specifically, one end of the first switch 141 is connected to the power supply unit 110, and an opposite end is connected to the node A to which the ring electrode 101 and the first capacitor 151 are connected. The first switch 141 is also connected to one end of the second capacitor 152 (node B), and the opposite end is grounded. As a result, the first switch 141 is enabled to selectively supply power to the ring electrode 101 and the first capacitor 151 according to an external control signal. The first switch 141 may concurrently discharge the second capacitor 152.

The comparator unit 160 compares a voltage value of the capacitor unit 150 with a predetermined reference voltage. Specifically, the comparator unit 160 may be implemented as an OP-AMP, in which case one input end of the OP-AMP is connected to one, non-grounded, end of the second capacitor 152 and an other input end of the OP-AMP receives a reference voltage. If the second capacitor 152 has a voltage exceeding the reference voltage, the comparator unit 160 outputs logic value 1, and if the second capacitor 152 has a voltage lower than the reference voltage, the comparator unit 160 outputs logic value 0. While the comparator unit 152 outputs a logic value 1 if the second capacitor 152 has a voltage exceeding the reference voltage, other alternatives are also possible. For example, logic value 0 may be output when the voltage of the second capacitor 152 exceeds the reference voltage.

The output unit 170 outputs a result of a comparison regarding the plurality of ring electrodes 101. Specifically, the output unit 170 may be implemented as a multiplexer (MUX) to receive outputs from the comparator unit 160 regarding the respective ring electrodes 101 and output a result indicating whether the ring electrodes 101 contain a defect. If the detecting unit 130 detects the defect of the ring electrodes 101 sequentially, the output unit 170 may output results of detection sequentially, using a shift register. The output unit 170 may be integrated in the detecting unit 130, or may be formed separately.

The operation of the detecting unit 130 according to an exemplary embodiment of the present general inventive concept will be explained below with reference to FIGS. 5A and 6D.

Figure 5A:
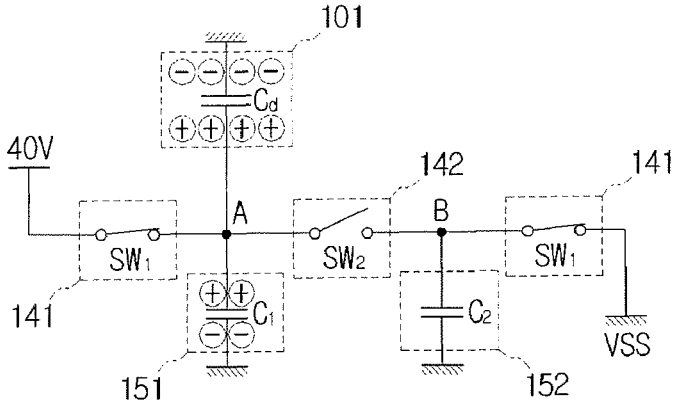
FIGS. 5A and 5B are circuit diagrams including a detection operation according to an exemplary embodiment of the present general inventive concept.
Figure 5B:
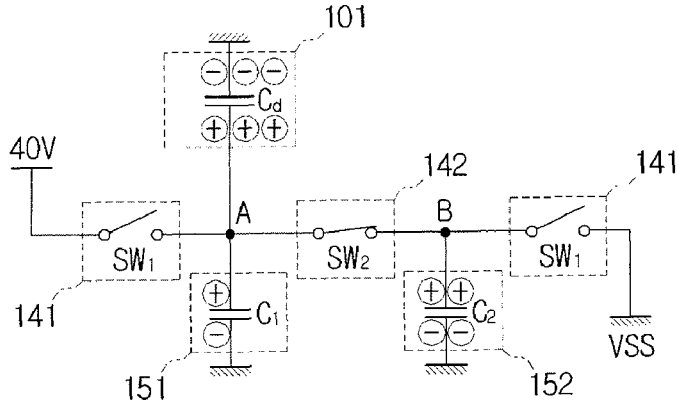

FIGS. 5A and 5B are circuit diagrams illustrating the detection operation according to an exemplary embodiment of the present general inventive concept, and FIGS. 6A to 6D are circuit diagrams illustrating the detection operation carried out according to an exemplary embodiment of the present general inventive concept, when the ring electrodes 101 of the image bearing structure contain a defect.

FIG. 5A illustrates the initial stage of the detection. In this stage, the first switch 141 is in an on state, and the second switch 142 is in an off state. Referring to FIGS. 3 and 5A, with the first switch 141 on, the ring electrodes 101 and the first capacitor 151 receive power through the power supply unit 120. Conversely, with the second switch 142 off, the second capacitor 152 is discharged. As a result, the node A has a same voltage 40V as the voltage received, and the node B has 0V.

FIG. 5B illustrates an operation after the ring electrodes 101 and the first capacitor 151 are charged with electric potential, in which the first switch 141 is in the off state and the second switch 142 is in the on state. Accordingly, the node A and the node B are connected to each other, so that some of the electric potential charged in the ring electrodes 101 and the first capacitor 151 is transferred to the second capacitor 152. As a result, the first capacitor 151 and the ring electrodes 101 have decreased voltage, while the second capacitor 152 has an increased voltage. Since the second capacitor 151 has a capacitance much lower than that of the ring electrodes 101, the nodes A and B have no considerate reduction of voltage and thus have approximately 35V.

Accordingly, referring to FIGS. 4 and 5B, the comparator unit 160 outputs logic value 1 to indicate a normal state, since the connected nodes A and B have a voltage value that exceeds the reference voltage which is approximately 25V.

Figure 6A:
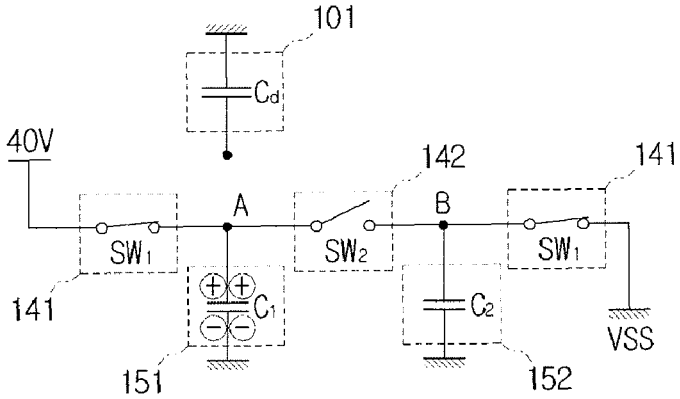
FIGS. 6A to 6D are circuit diagrams including a detection operation performed when the image bearing structure contains a defect in a ring electrode.

FIG. 6A illustrates an initial stage of the detection, when the ring electrodes 101 have open circuits, in which the first switch 141 is in the on state and the second switch 142 is in the off state. With the first switch 141 on, the first capacitor 151 receives power through the power supply unit 120. Since the ring electrodes 101 have short circuits from the power supply unit 120, the ring electrodes 101 do not receive power. As a result, the first capacitor 151 and the ring electrodes 101 have a lower amount of electric potential than in a normal operation.

Figure 6B:
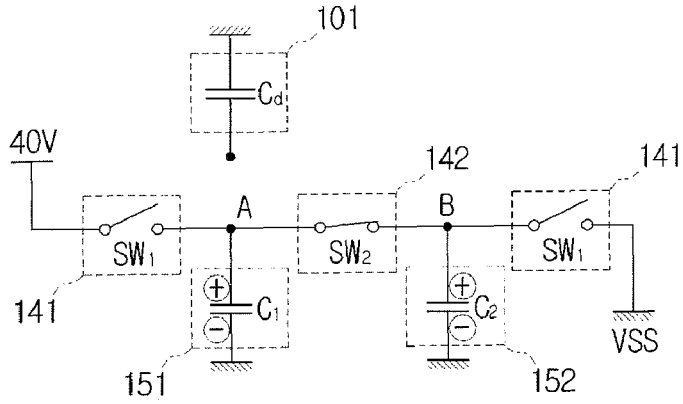

FIG. 6B illustrates an operation after capacitor charge, when the ring electrodes 101 have open circuits, in which the nodes A and B are connected to each other, and thus some of the electric potential of the first capacitor 151 is transferred to the second capacitor 152. In this case, the second capacitor 152 has a greater capacitance than the first capacitor 151, and thus the connected nodes A and B have significantly decreased voltage, about 25V.

Since the connected nodes A and B have a lower voltage than the reference voltage, which is about 25V, the comparator unit 160 outputs a logic value 0 to indicate that the ring electrodes 101 have a defect.

Figure 6C:
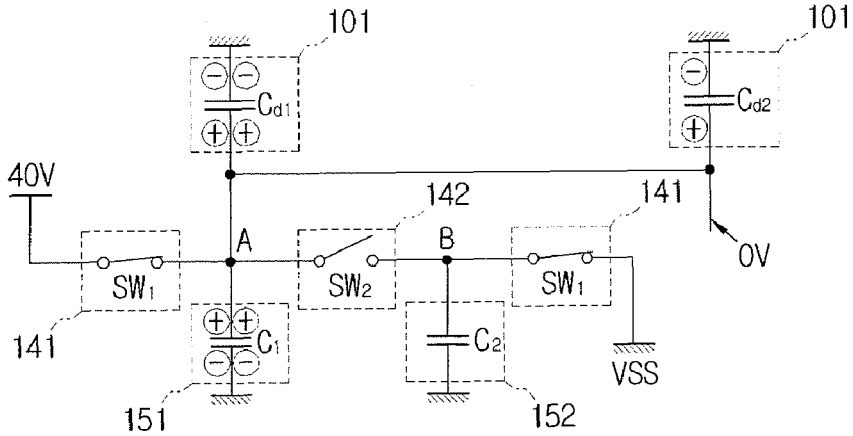
Figure 6D:
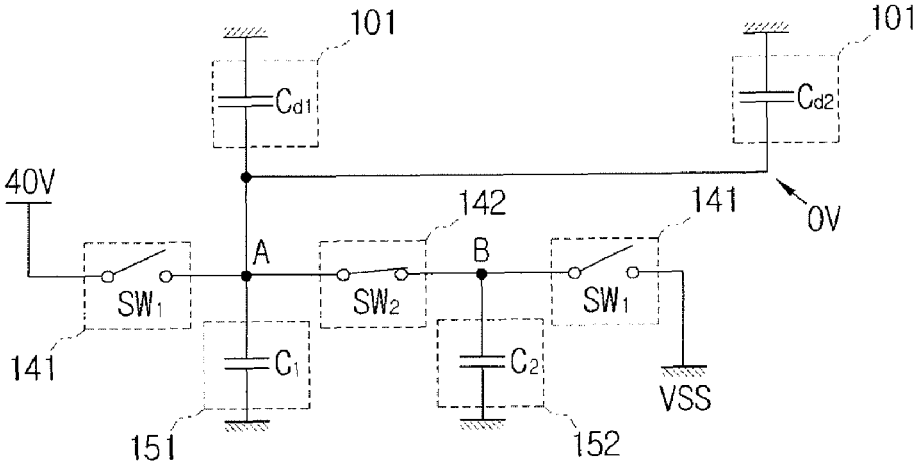

FIGS. 6C and 6D illustrate the detection operation carried out when the ring electrodes 101, illustrated as $C_{d1}$ and $C_{d2}$, have short circuits.

Referring to FIG. 6C, the first switch 141 is in on state and the second switch 142 is in off state. With the first switch 141 on, the first capacitor and the ring electrodes 101 receive power through the power supply unit 120. However, since the ring electrodes 101 have short circuits, the electric potential is not charged, but leaked outside, and thus results in an insufficient charge.

Referring to FIGS. 4 and 6D, the nodes A and B are connected to each other. However, since the ring electrodes 101 have short circuits, the electric potential of the first capacitor 151 is discharged through the shorted portion. As a result, the second capacitor 152 receives no electric potential. Since the connected nodes A and B have relatively lower voltage than the reference voltage (25V), the comparator unit 160 outputs a logic value 0 to indicate that the ring electrodes 101 have a defect.

As explained above, the image bearing structure according to the exemplary embodiments of the present general inventive concept has a defect detecting function integrated in the control board thereof, and is thus able to detect a defect, without requiring a separate detecting device. Furthermore, the image bearing structure detects a defect of the ring electrodes efficiently, by employing an electric circuit.

Figure 7:
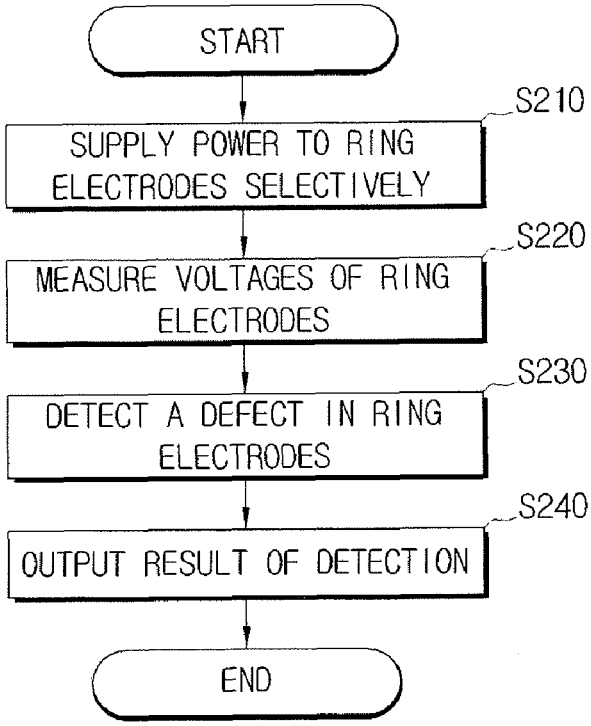
FIG. 7 is a flowchart including a method to detect a defect in an image bearing structure according to an exemplary embodiment of the present general inventive concept.

FIG. 7 is a flowchart illustrating a method to detect a defect of an image bearing structure according to an exemplary embodiment of the present general inventive concept.

At operation S210, power is selectively supplied to a plurality of ring electrodes 101. Specifically, the power is supplied to the plurality of ring electrodes 101 and the first capacitor 151 which is connected to the ring electrodes 101 in parallel, while the second capacitor 152 connected in parallel with the ring electrodes is discharged. This operation has been explained above with reference to FIGS. 5A, 6A and 6C.

At operation S220, the voltages of the ring electrodes 101 are measured, respectively. Specifically, the ring electrodes 101 and the first and second capacitors 151 and 152 are connected to each other. The voltages of the ring electrodes 101 are then measured. This operation has been explained above with reference to FIGS. 5B, 6B and 6D.

At operation S230, the measured voltage is compared with a predetermined reference voltage to determine whether each of the ring electrodes 101 contains a defect. Specifically, a voltage, measured through an OP-AMP, is compared with the reference voltage. At operation S240, whether the ring electrodes 101 have a defect, is output.

The above detecting operation may be repeated for a plurality of ring electrodes 101, concurrently or sequentially. In the case of detecting a defect of the ring electrodes 101 sequentially, the result of detecting a defect can be output in a serial manner.

As a result, a method to detect a defect of an image bearing structure according to the exemplary embodiments of the present general inventive concept can provide a result of detection efficiently, through the use of circuit integrated on a board.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An image bearing device, comprising:

an image drum comprising at least one slot;

a plurality of ring electrodes formed on an outer circumference of the image drum; and a control board positioned within the slot of the image drum, and connected to the plurality of ring electrodes, to detect a defect of the ring electrodes, wherein the control board comprises:

a power supply unit to supply power to the plurality of ring electrodes; and a detecting unit to detect a defect by measuring a voltage value of the ring electrodes.

2. The image bearing device of claim 1, wherein the detecting unit comprises:

a capacitor unit connected to the plurality of ring electrodes in parallel;

a switch unit to adjust the supply of power to the ring electrodes and the capacitor unit according to an external control signal; and a comparator unit to compare the voltage value of the capacitor unit with a predetermined reference voltage.

3. The image bearing device of claim 2, wherein the capacitor unit comprises:

a first capacitor to maintain a same electric potential as that of the ring electrodes; and a second capacitor to be selectively connected to the ring electrodes according to the connection state of the switch unit.

4. The image bearing device of claim 3, wherein the switch unit comprises:

a first switch to connect the power supply unit to the first capacitor and the ring electrodes selectively; and a second switch to connect the ring electrodes to the second capacitor selectively.

5. The image bearing device of claim 3, wherein the second capacitor has a greater capacitance than a capacitance of the first capacitor.

6. The image bearing device of claim 2, wherein the comparator unit comprises:

an OP-AMP.

7. The image bearing device of claim 2, further comprising:

an output unit to output a result of a comparison to the plurality of ring electrodes.

8. The image bearing device of claim 1, wherein the power supply unit and the detecting unit are integrated in a single application-specific integrated circuit (ASIC) chip.

9. The image bearing device of claim 1, wherein the image drum comprises:

a hollow cylindrical body; and at least one slot extending in a lengthwise direction.

10. A method to detect a defect in an image bearing device including an image drum, and a plurality of ring electrodes formed on an outer circumference of the image drum, the method comprising:

supplying power to the plurality of ring electrodes selectively;

measuring voltages of the ring electrodes respectively; and detecting a defect in each of the ring electrodes by comparing the measured voltages with a predetermined voltage value, wherein the supplying operation comprises:

supplying the power to the plurality of ring electrodes and to a first capacitor connected to the plurality of ring electrodes in parallel; and discharging a second capacitor which is connected to the plurality of ring electrodes in parallel.

11. The method of claim 10, wherein the measuring operation comprises:

connecting the plurality of ring electrodes and the first capacitor to the second capacitor; and measuring the voltages of the plurality of ring electrodes, respectively.

12. The method of claim 10, wherein the detecting operation comprises:

comparing the measured voltages with a predetermined voltage value using an OP-AMP.

13. The method of claim 10, wherein the supplying operation, measuring operation and detecting operation are performed with respect to each of the plurality of ring electrodes in sequential order.

14. The method of claim 13, further comprising:

outputting a result of the detection with respect to the plurality of ring electrodes in a serial manner.

15. An image bearing device, comprising:

an image drum having a plurality of ring electrodes; and a detecting unit disposed in the image drum to detect a defect in each of the ring electrodes by comparing measured voltages of the ring electrodes with a predetermined voltage value.

16. An image bearing device, comprising:

an image drum having a plurality of ring electrodes;

a capacitor unit connected to the plurality of ring electrodes;

a switch unit to adjust a supply of power to the ring electrodes and the capacitor unit according to an external control signal; and a comparator unit to compare a voltage value of the capacitor unit with a predetermined reference voltage, wherein a defect in the plurality of rings is identified based on a compared result of the comparator unit.

17. A computer-readable recording medium having embodied thereon a computer program to execute a method, wherein the method comprises:

measuring voltages of ring electrodes with a detecting apparatus disposed within an image drum; and detecting a defect in each of the ring electrodes by comparing the measured voltages of the ring electrodes with a predetermined voltage value.

18. An image bearing apparatus, comprising:

an image drum;

a plurality of ring electrodes formed on an outer circumference of the image drum; and a control board disposed within the image drum, and connected to the plurality of ring electrodes, to detect a defect of the ring electrodes with an applied voltage.

19. An image bearing apparatus, comprising:

an image drum having a plurality of ring electrodes; and a detecting apparatus disposed within the image drum to compare a measured voltage value of at least one of the plurality of ring electrodes with a predetermined voltage to detect a defect in the at least one of the plurality of ring electrodes.

20. A method to detect a defect in at least one ring electrode formed on an outer circumference of an image drum of an image bearing apparatus, the method comprising:

measuring a voltage of the at least one ring electrode with a measurement apparatus disposed within the image drum; and comparing a measured voltage value of the at least one of the plurality of ring electrodes with a predetermined voltage with a controller to detect a defect in the at least one of the plurality of ring electrodes.

* * * * *